US007478442B2

(12) United States Patent
King

(10) Patent No.: US 7,478,442 B2
(45) Date of Patent: Jan. 20, 2009

(54) DISPENSING APPARATUS

(75) Inventor: Joseph A. King, Wayzata, MN (US)

(73) Assignee: King Technology, Hopkins, MN (US)

( * ) Notice: Subject to any disclaimer, the term of this patent is extended or adjusted under 35 U.S.C. 154(b) by 390 days.

(21) Appl. No.: 11/082,436

(22) Filed: Mar. 17, 2005

(65) Prior Publication Data

US 2006/0207009 A1 Sep. 21, 2006

(51) Int. Cl.
*E04H 4/00* (2006.01)

(52) U.S. Cl. ..... 4/498; 4/222

(58) Field of Classification Search ..... 4/498, 4/222, 227.1, 230, 490, 546, 662; 220/87.1, 220/87.2, 254.9; 222/83.5, 88, 90
See application file for complete search history.

(56) References Cited

U.S. PATENT DOCUMENTS 576,398 A * 2/1897 Fortune ..... 4/483
939,424 A * 11/1909 Kneen ..... 4/227.1
6,738,989 B2 * 5/2004 Harbutt et al. ..... 4/227.1

* cited by examiner

*Primary Examiner*—Huyen Le
(74) *Attorney, Agent, or Firm*—Jacobson & Johnson

(57) ABSTRACT

A dispenser delivery system for a closed container that permits periodic dispensing of a dispersant into a fluid in the container without having to remove a cover over the container.

20 Claims, 3 Drawing Sheets

DISPENSING APPARATUS

FIELD OF THE INVENTION

This invention relates generally to delivery systems and more specifically a container and dispenser combination for periodically delivering materials to a body of water.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of containers that hold a body of water for human use are well known in the art. One such container that holds a recreational body of water is known as a spa or hot tub. Spas and hot tubs are used in all types of climates and are generally maintained at a comfortable temperature so that a person can immerse himself or herself in the body of water. Generally, the spas or hot tubs are located outdoors. In colder climates this means that even though the outside temperature may be below freezing the temperature of the body of recreational water in the spa or hot tub needs to be maintained well above the freezing point. As bacteria and other organisms can grow in the body of water it is necessary to periodically apply disinfectants or other water treatment materials to the body of water to bring the water to proper recreational levels. Oftentimes the use of the spa or hot tub can be sporadic; however it is still necessary to periodically attend to maintaining the proper quality of the recreational water. In the wintertime this can entail the user removing the cover from the spa and dispensing the proper materials into the water to bring the water quality up to a level for recreational use. The cover is then placed back on the spa or hot tub. If the weather is cold the user might procrastinate or neglect to attend to the dispensing of materials until the weather warms up. At other times the user may be on vacation for a length of time. In each case it is desirable that the user periodically dispense the materials into the body of recreational water even though the weather is inclement or the user is on vacation. The present invention provides a dispensing system for a body of water that can use the latent heat of the body of water to maintain the dispersant in a deliverable state for periodic delivery either through a manual activation or through a timer that periodically dispenses the dispersant into the body of water.

BRIEF SUMMARY OF THE INVENTION

Briefly, the invention includes a dispenser delivery system for a closed container that permits periodic dispensing of a dispersant into a fluid in the container without having to remove a cover over the container. In one embodiment the dispenser can be filled or activated through controls extending through a cover to the dispensing delivery system and in another a timer contained within the container can be set to periodically deliver dispersant to the body of fluid in the container.

DESCRIPTION OF THE PREFERRED EMBODIMENT

Figure 1:
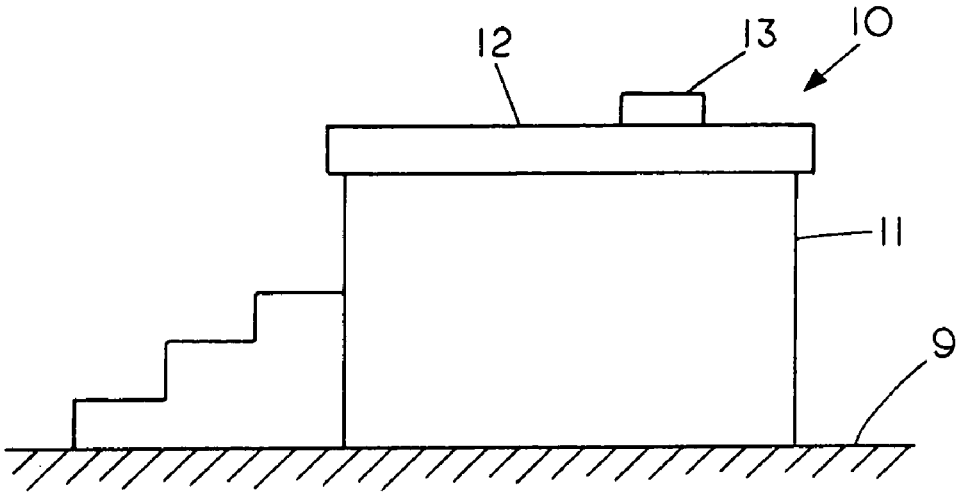
FIG. 1 is a side view of a spa with a cover.

FIG. 1 is a front view of spa or hot tub 10 that is located on a platform 9. The spa includes a container 11 with a cover 12 that extends over the container to keep the body of recreational water therein free of debris. A thermostatic controlled heater maintains the proper temperature of the water in the container. In addition the cover and container generally include insulation to help maintain the water at the proper temperature.

Located on top of cover 10 is a hood 13 that extends over a set external controls for the delivery of dispersants from a dispenser located in the air space beneath the cover and the body of water and preferably as an attachment to the cover.

Figure 2:
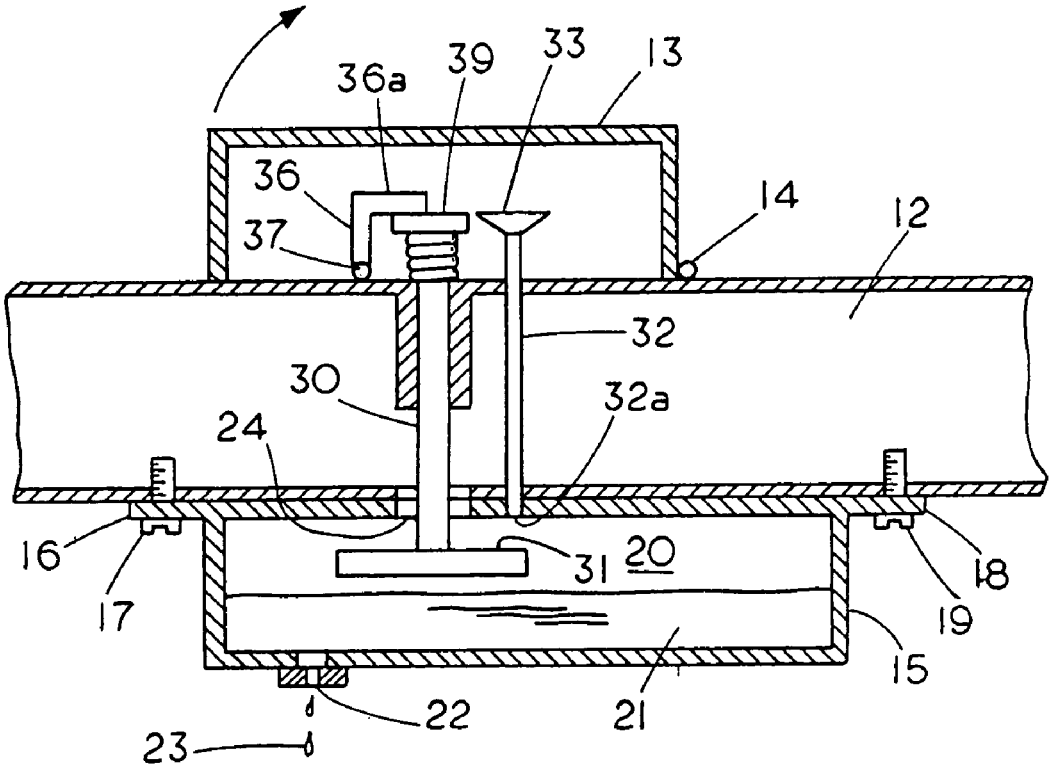
FIG. 2 is a partial section view of the cover of the spa of FIG. 1 with a dispenser delivery system in a delivery mode.

FIG. 2 shows a partial cross sectional view of the cover 12 and hood 13 to reveal the dispensing system for periodically dispensing dispersant into the body of water in the spa. Located on the underside of cover 12 is a dispenser 15 that has a first ear 16 that is secured to cover 12 through a screw 17 and a second ear 18 that are secured to cover 12 through a screw 19.

FIG. 2 shows the dispenser in the dispensing position as well as the external filling condition. Located within container 15 is a dispersant 21. An aperture 22 in the lower portion of dispenser 15 provides for gravity feed of dispersants from chamber 21 in dispenser 15. An external supply tube 32 extends upward to a funnel 33 that allows one to inject dispersant into the container 15 by pivoting back hood 13 without having to open the cover 12. Positioned alongside of tube 32 is a push rod 30 that has a sealing member 31 on one end and a handle 39 on the opposite end. An L shaped latch member 36 having a hinge 37 is shown with surface **36*a* holding push rod 30** in the open position.

With the push rod 30 is in the dispensing position as shown in FIG. 2 the dispersant 21 in chamber 20 can be delivered to the body of water through the aperture or port 22. In addition a fresh charge of dispersant can be added to the dispenser 15 by pivoting hood 13 about hinge 14 to expose the funnel 33 for insertion of dispersant therein, which will flow through tube 32 an into the chamber 20. The embodiment of FIG. 2 allows one to deliver dispersant at a controlled rate even though a person is not present since droplets of dispersant 23 can be emitted from port 22 through a drip feed. By sizing the port 22 for the dispersants one can control the dispersant rate. For example, if the dispersant is of the type that needs to be delivered all at once a larger delivery port can be used. On the other hand if the dispersant is of the type that should be delivered over an extended period of time a small delivery port can be used and the dispersant can be allowed to drip feed into the body of water.

Figure 3:
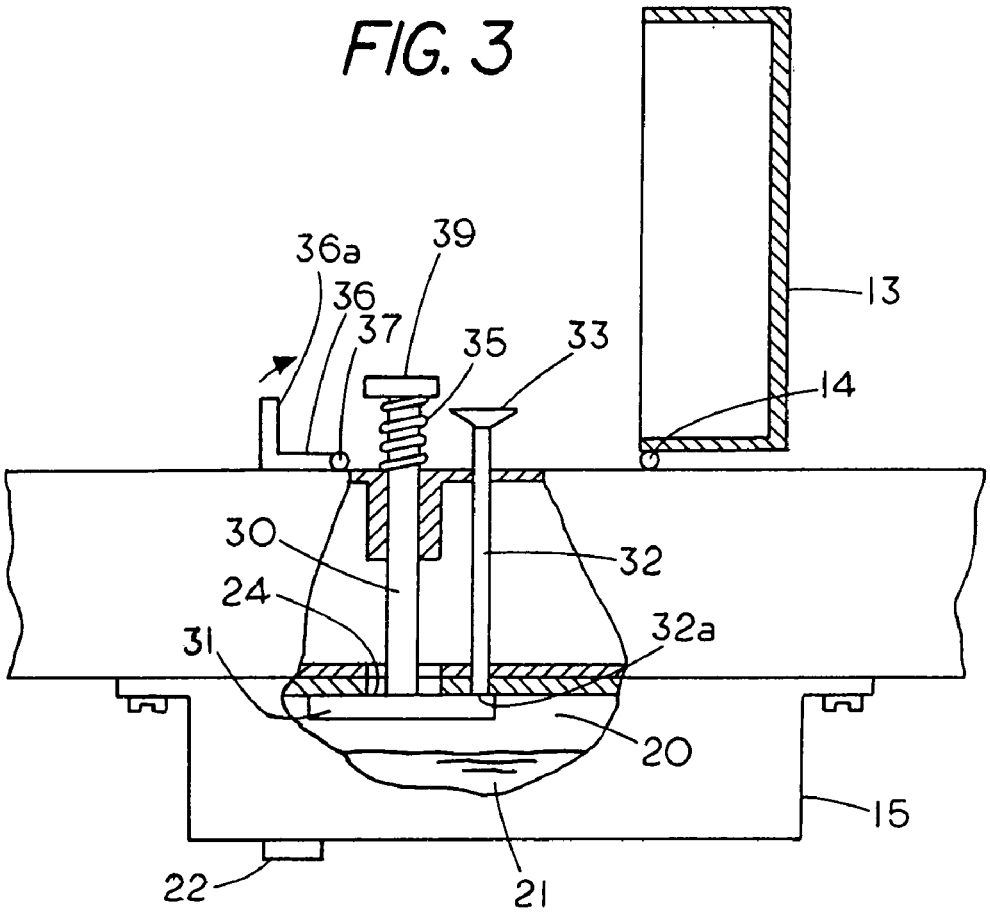
FIG. 3 is a partial sectional view of the cover of the spa of FIG. 1 in a closed or non-delivery condition.

FIG. 3 shows the dispensing system of FIG. 2 in the non-dispensing condition. Hood 13 has been pivoted back on hinge 14 to reveal how the hood can be swung to an out of the way. In addition the latch member 36 has been pivoted to an unlatched condition by rotating latch member 90 degrees about hinge 37. As the compression spring 35 around push rod 30 exerts an upward force on handle 39 it brings the handle to the up condition, which brings the sealing member 31 to a closed condition that closes the top opening 24. Sealing the container 15 has two effects first, it prevents any dispersant from escaping form container 15 since air cannot enter or escape from the container 15. In this condition one can manually operate the dispenser by pushing down on the handle 39 to allow air to enter chamber 20 thereby allowing the dispersant therein to be dispensed into the body of recreational water. Second, by pushing down on handle 39 one also permits the addition of additional dispersant to chamber 20 (see FIG. 2) since the end 32*a* becomes unsealed to allow the dispersant to flow into chamber 20.

Thus, the embodiment of FIG. 2 and FIG. 3 allow for both on demand manual deliver or extended dispersant delivery without the user having to open the cover 12 of the spa or hot tub. As a result the delivery of the dispersant to the body of recreational water becomes easier since the large cover need not be removed from the container, which generally means there is less tendency to neglect or procrastinate on the regular treatment of the water in the container.

Figure 4:
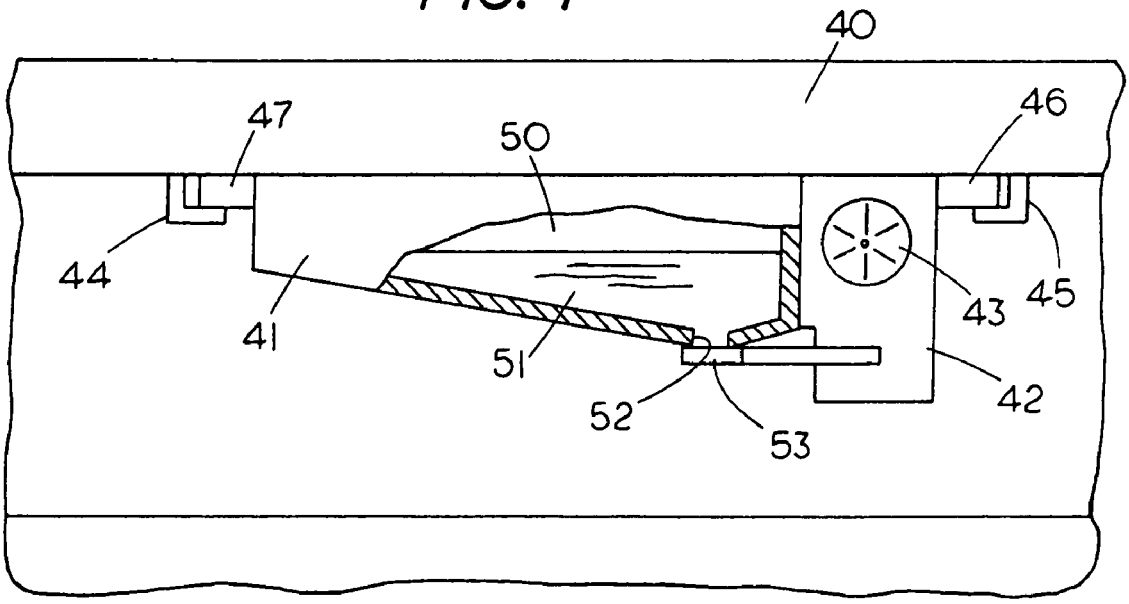
FIG. 4 is a partial section of a spa cover with a timer controlled dispenser delivery system in the non-delivery mode.

FIG. 4 shows an alternate embodiment of the invention that can also deliver dispersant without having to remove the cover of the hot tub. The embodiment of FIG. 4 includes a timer for controlling the delivery of the dispersant to the body of water and a shutoff member to stop or start deliver of dispersant.

FIG. 4 shows a portion of a cover 40 with a first member or lip 44 secured to one portion of the cover and a second L shaped member or lip 45 secured to another portion of the cover. The purpose of lips 44 and 46 is to allow one to quickly attach a dispenser 41 to the underside of cover 40 so the dispenser can be held in a ready to use condition. That is, one can attach or detach a dispenser 41 to the underside of cover 40 by merely sliding the dispenser along the underside of the cover until dispenser flange 47 and dispenser flange 46 engage their respective lips. In this condition the dispenser is in a ready to use condition beneath the cover 40. The dispenser can be provided with one or more dispersants and can contain enough dispersants for many months. With the dispenser 41 located in the air space above the body of water the latent heat of the water can maintain the dispersant in a non-freezing condition, this is particular beneficial when the dispersant is or contains a liquid. On the other hand, a solid dispersant which may be in tablet or granular form can also be used with the dispenser 41.

The embodiment of FIG. 4 differs from the embodiment of FIG. 2 in that the dispenser 41 includes a shutoff member 53 that can be controlled by a timer 42. Timer 42 includes a dial 43 for setting the time of day as well as the day of delivery of material from dispenser 41. Dispenser 41 is shown in partial section having a liquid dispersant 51 in chamber 50. In the embodiments shown a sealing member or shutoff member 53 extends laterally across port 52 to prevent egress of dispersant from chamber 50. The sealing member is controlled by the timer 42. FIG. 4 shows the shutoff member 53 in the closed condition.

Figure 5:
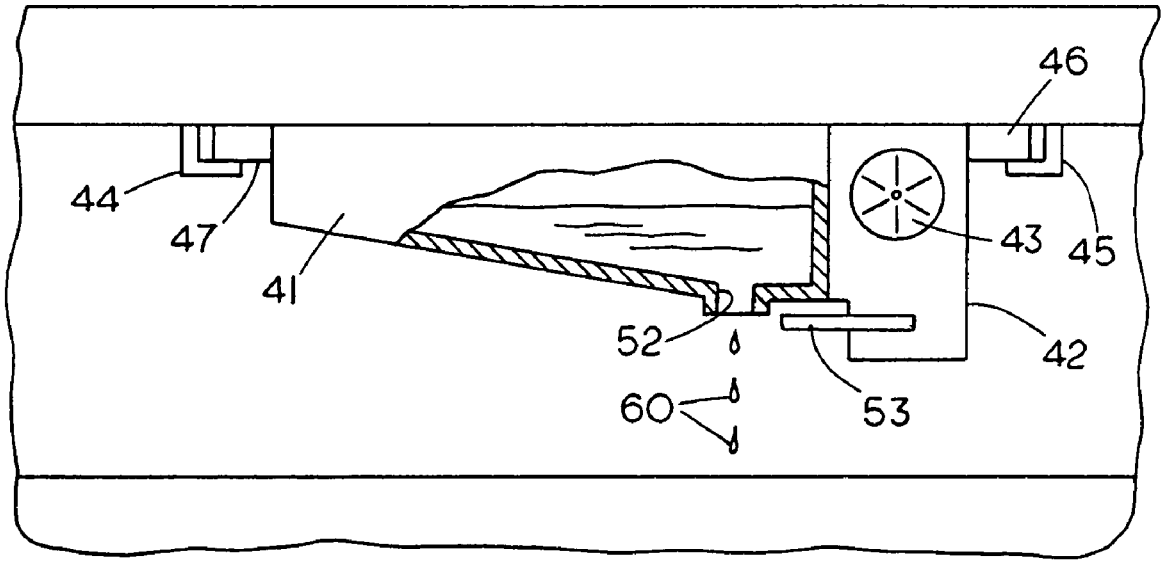
FIG. 5 is a partial section view of a spa cover with the time controlled dispenser delivery system of FIG. 4 in the dispensing mode.

FIG. 5 shows the dispenser 41 in the dispensing condition. In this condition the port 52 has been uncovered as the sealing or shutoff member 53 has been slid laterally toward the right until the port 52 is open. In this condition the dispersant 60 can escape from dispenser 41. When sufficient amount of dispersant has been discharged the timer closes the port 52 by extending sealing member 53 there across as shown in FIG. 4.

Thus in the embodiment of FIG. 4 and FIG. 5 one can periodically deliver dispersant to the spa or hot tub even though one might not be present. In addition since the delivery system is contained in the air chamber and above the water line or a fluid gas interface line the latent heat of the water as well as the insulation of the cover allow the dispersant to be maintained in a condition that permits delivery of dispersant.

In both embodiments the user need not remove the cover once a charge of dispersant has been placed in the dispenser. Depending on the type of dispersant required as well as the frequency of delivery either the dispersant delivery system of FIG. 2 and FIG. 3 or the dispersant delivery system of FIG. 3 and FIG. 4 or both can be used to timely deliver the dispersant to the body of fluid contained in the container. Thus the present invention provides for undercover delivery of a dispersant without the user having to remove the cover each time a charge of dispersant is delivered to the container.

While the present invention has been described in relation to spa or hot tubs, once the present invention is known it will be envisioned that the dispensing apparatus of the present invention can be used with a variety of fluids that require periodic maintenance as well as other systems that require periodic maintenance of the fluid in the system.

The invention claimed is:

1. A spa comprising:

a container for holding a body of recreational water;

a heater for heating and maintaining the proper temperature of said body of recreational water;

a spa cover extendible over the container to maintain the body of recreational water in a protected condition;

a dispenser secured to said spa cover, said dispenser having a chamber therein;

a fluid delivery port in said dispenser;

a fluid inlet in said dispenser; and a sealing member for closing said fluid inlet to said dispenser to prevent dispersant egress from a chamber in said dispenser, said sealing member operable from outside of said container to permit dispersing of a dispersant without the user having to remove the spa cover of the container, said sealing member having a through-the-cover push rod to permit manual activation of the dispenser from a position outside of the spa cover.

2. The spa of claim 1 wherein said fluid delivery port is located on a lower portion of the dispenser to permit gravity feed of a dispersant located in a chamber in the dispenser.

3. The spa of claim 1 including a hood securable to the cover for shielding a cover control member from external elements.

4. The spa of claim 1 wherein the dispersant contained therein is a liquid.

5. A spa comprising:

a container for holding a body of recreational water;

a heater for heating and maintaining the proper temperature of said body of recreational water;

a spa cover extendible over the container to maintain the body of recreational water in a protected condition;

a dispenser secured to said spa cover, said dispenser having a chamber therein;

a fluid delivery port in said dispenser;

a fluid inlet in said dispenser;

a sealing member for closing said fluid inlet to said dispenser to prevent dispersant egress from a chamber in said dispenser, said sealing member operable from outside of said container to permit dispersing of a dispersant without the user having to remove the spa cover of the container, said sealing member having a through-the-cover push rod to permit manual activation of the dispenser from a position outside of the spa cover; and a compression spring to provide a bias force to hold the sealing member in a closed condition.

6. A spa comprising:

a container for holding a body of recreational water;

a heater for heating and maintaining the proper temperature of said body of recreational water;

a spa cover extendible over the container to maintain the body of recreational water in a protected condition;

a dispenser secured to said spa cover, said dispenser having a chamber therein;

a fluid delivery port in said dispenser;

a fluid inlet in said dispenser;

a sealing member for closing said fluid inlet to said dispenser to prevent dispersant egress from a chamber in said dispenser, said sealing member operable from outside of said container to permit dispersing of a dispersant without the user having to remove the spa cover of the container, said sealing member having a through-the-cover push rod to permit manual activation of the dispenser from a position outside of the spa cover; and a latch for servicing the sealing member in an open condition.

7. A spa comprising:

a container for holding a body of recreational water;

a cover extendible over the container to maintain the body of recreational water in a protected condition;

a dispenser secured to said cover, said dispenser having a chamber therein;

a fluid delivery port in said dispenser;

a fluid inlet in said dispenser;

a sealing member for closing said fluid inlet to said dispenser to prevent dispersant egress from a chamber in said dispenser, said sealing member operable from outside of said container to permit dispersing of a dispersant without the user having to remove the cover of the container, said sealing member having a through-the-cover push rod to permit manual activation of the dispenser from a position outside of the cover; and an inlet supply tube extending through the cover to permit filling the dispenser with dispersant without the user having to remove the cover of the container.

8. A spa comprising:

a container for holding a body of recreational water;

a heater for heating and maintaining the proper temperature of said body of recreational water;

a spa cover extendible over the container to maintain the body of recreational water in a protected condition;

a dispenser secured to said spa cover, said dispenser having a chamber therein and said dispenser maintained in an air space above a body of recreational water in the container to permit the latent heat of the body of water to maintain the dispersant in a liquid state;

a fluid delivery port in said dispenser;

a fluid inlet in said dispenser; and a sealing member for closing said fluid inlet to said dispenser to prevent dispersant egress from a chamber in said dispenser, said sealing member operable from outside of said container to permit dispersing of a dispersant without the user having to remove the spa cover of the container, said sealing member having a through-the-cover push rod to permit manual activation of the dispenser from a position outside of the spa cover.

9. A spa dispenser delivery system comprising:

a spa container for holding a body of recreational water that a person can immerse oneself therein;

a heater for heating and maintaining the proper temperature of said body of recreational water;

a spa cover extendible over said spa container to form an enclosure around the body of recreational water; and a dispenser located in the enclosure with the dispenser discharging a dispersant into the spa container when the spa cover and the spa container are in a closed condition.

10. The spa dispenser delivery system of claim 9 wherein the dispenser is located above a fluid gas interface line in the spa container.

11. The dispenser delivery system of claim 9 wherein the dispenser includes a timer for periodic delivery of dispersant to the body of fluid.

12. The dispenser delivery system of claim 9 wherein the dispenser includes a slidable shutoff member for opening and closing a dispersant delivery port on the dispenser wherein the dispenser is confined within an enclosure between the cover and the container.

13. The dispenser delivery system of claim of claim 9 wherein the dispenser is removable attachable to an underside of the cover.

14. The dispenser delivery system of claim 9 wherein the dispenser contains a solid dispersant.

15. A method of periodic delivery of a dispersant to a closed system comprising:

forming a spa container for holding a body of recreational water that a person can immerse oneself therein;

heating said body of recreational water;

forming a spa cover for extending over the spa container to form a closed container;

placing a dispenser in the closed container; and periodic dispensing the dispersant from the dispenser into the body of recreational water without removing the spa cover from the spa container.

16. The method of periodic delivery of dispersant to a closed system of claim 15 including positioning the dispenser above a fluid gas interface line in the spa container.

17. The method of periodic delivery of dispersant to a closed system of claim 15 wherein a timer is attached to the dispenser to control the delivery of the dispersant.

18. The method of periodic delivery of dispersant to a closed system of claim 15 wherein the dispenser is secured to an underside of the spa cover.

19. The method of periodic delivery of dispersant to a closed system of claim 15 wherein a control member is extended through the spa cover to permit external control of the dispersant from outside of the spa container.

20. The method of periodic delivery of dispersant to a closed system of claim 15 wherein the dispersant is maintained in a non-freezing condition by a latent heat of the body of recreational water.

* * * * *